US009074808B2

(12) United States Patent
Kim et al.

(10) Patent No.: US 9,074,808 B2
(45) Date of Patent: Jul. 7, 2015

(54) TOWER PANTRY IN REFRIGERATOR

(71) Applicant: LG Electronics Inc., Seoul (KR)

(72) Inventors: Nami Kim, Seoul (KR); Taegyeong Kim, Seoul (KR); Jaeyoul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/922,290

(22) Filed: Jun. 20, 2013

(65) Prior Publication Data

US 2014/0001943 A1 Jan. 2, 2014

(30) Foreign Application Priority Data

Jul. 2, 2012 (KR) ..... 10-2012-0071545

(51) Int. Cl.
*F25D 25/02* (2006.01)
*A47B 96/04* (2006.01)
*A47B 88/00* (2006.01)

(52) U.S. Cl.
CPC ..... *F25D 25/022* (2013.01); *F25D 25/024* (2013.01); *F25D 25/021* (2013.01)

(58) Field of Classification Search
CPC ..... F25D 23/00; F25D 23/06; F25D 23/065; F25D 23/067; F25D 25/02; F25D 25/021; F25D 25/022; F25D 25/024; F25D 25/025; F25D 2325/021; F25D 2500/06
USPC ..... 312/404, 408, 311, 306, 301, 330.1; 108/102, 137, 143, 180, 186; 211/153, 211/126.15, 151, 90.01, 186, 188, 189, 194
See application file for complete search history.

(56) References Cited

U.S. PATENT DOCUMENTS

| | | | | | |
|---|---|---|---|---|---|
| 1,833,935 | A | * | 12/1931 | Dickey | 211/153 |
| 2,159,601 | A | * | 5/1939 | Nauert | 211/153 |
| 2,825,617 | A | * | 3/1958 | Morgan | 312/351 |
| 3,212,835 | A | * | 10/1965 | Beckett et al. | 312/311 |
| 4,318,635 | A | * | 3/1982 | Gurtner et al. | 405/126 |
| 5,152,230 | A | * | 10/1992 | Licari | 108/158.11 |
| 5,651,597 | A | * | 7/1997 | Oslin | 312/350 |
| 5,921,411 | A | * | 7/1999 | Merl | 211/90.01 |
| 5,964,360 | A | * | 10/1999 | Hwang | 211/186 |
| 5,980,009 | A | * | 11/1999 | Atalla et al. | 312/408 |

(Continued)

FOREIGN PATENT DOCUMENTS

| | | | |
|---|---|---|---|
| KR | 1999-0049539 | A | 7/1999 |
| KR | 2004-0059041 | A | 7/2004 |

(Continued)

OTHER PUBLICATIONS

Korean Office Action dated Jul. 31, 2013 for Application No. 10-2012-00751545, with English Translation, 6 Pages.

*Primary Examiner* — Daniel J Troy
*Assistant Examiner* — Andrew Roersma
(74) *Attorney, Agent, or Firm* — Fish & Richardson P.C.

(57) ABSTRACT

A tower pantry includes a guide mechanism mounted on a bottom of an opened space inside a refrigerating room and a basket attached to the guide mechanism and configured to move forward and backward on the first guide mechanism. The tower pantry also includes frames that are fastened to corners of the first basket and that vertically extend from the first basket. The tower pantry further includes a frame cover fastened on the frames and defining a space that accommodates a large-size beverage container.

16 Claims, 8 Drawing Sheets

(56) References Cited

U.S. PATENT DOCUMENTS

| | | | | |
|---|---|---|---|---|
| 6,220,682 | B1 * | 4/2001 | Vertullo | 312/334.28 |
| 6,253,568 | B1 * | 7/2001 | Peffley | 62/441 |
| 7,469,793 | B2 * | 12/2008 | Chen | 211/162 |
| 2004/0135481 | A1 * | 7/2004 | Diebold et al. | 312/408 |
| 2009/0293533 | A1 * | 12/2009 | Lim et al. | 62/465 |
| 2010/0253197 | A1 * | 10/2010 | Jung | 312/408 |
| 2010/0307186 | A1 * | 12/2010 | Kwon et al. | 62/407 |

FOREIGN PATENT DOCUMENTS

| | | | | |
|---|---|---|---|---|
| KR | 1020120010934 | A * | 2/2012 | F25D 25/02 |
| WO | WO2009115277 | A2 * | 9/2009 | F25D 25/02 |

* cited by examiner

TOWER PANTRY IN REFRIGERATOR

CROSS-REFERENCE TO RELATED APPLICATION

This application claims priority from Korean Application No. 10-2012-0071545, filed Jul. 2, 2012, the subject matter of which is incorporated herein by reference.

FIELD

The present disclosure relates to a tower pantry in a refrigerator.

BACKGROUND

A refrigerator is divided into a freezing room and a refrigerating room, and various kinds of refrigerators have recently come into wide use. As shown in FIG. 1, a multi-door refrigerator 100 can include a refrigerating room 10 disposed at an upper portion thereof and a freezing room 20 disposed at a lower portion thereof.

Left and right doors 30 and 31 respectively opened or closed by left and right rotations thereof can be mounted at the refrigerating room 10 disposed at the upper portion of the refrigerator 100 as described above. One door opened or closed by being pulled forward or pushed backward can be mounted at the freezing room 20.

A plurality of shelves 10*a* and 10*b* and drawer-type trays 10*d*, 10*e* and 10*f* for keeping vegetables, fish, etc. are provided inside the refrigerating room 10, and a tray cover 10*c* for covering the trays so as to separate the trays from a shelf space is mounted on the upper surface of the trays.

Shelf-type baskets 30*a*, 30*b*, 31*a* and 31*b* each having an opening can be provided inside the left and right doors 30 and 31 in order to keep beverages and the like therein.

The baskets provided inside the doors as described above reflect characteristics of the doors. Thus, the size of beverages to be kept in the baskets may be limited due to constraints of the doors.

In some refrigerators, a large-capacity beverage with a gallon size, which is about 4.54 liters in the U.K. and about 3.785 liters in the U.S.A., may not fit in a basket provided on a door. Hence, the large-capacity beverage is placed on a shelf or tray cover mounted in an internal space of the refrigerating room. This placement may make the use of the beverage less convenient.

SUMMARY

In one aspect, a tower pantry in a refrigerator includes a guide mechanism mounted on a bottom of an opened space inside a refrigerating room and a basket attached to the guide mechanism and configured to move forward and backward on the guide mechanism. The tower pantry also includes frames that are fastened to corners of the basket and that extend vertically from the basket. The frames have a length that is greater than a height of a gallon size beverage container. The tower pantry further includes a frame cover fastened on the frames and defining a space that accommodates the gallon size beverage container in the basket.

Implementations may include one or more of the following features. For example, the guide mechanism may include a rail fixed to the bottom of the opened space inside the refrigerating room, and a slide fastened to the basket and configured to slide along the rail. In this example, holes may be respectively formed at both end portions of the slide, and the basket may attach to the slide based on shafts that pass through corners of the basket and that are fastened into the holes. Further, in this example, the shafts passing through the corners of the basket may be vertically fastened to the frames.

In some implementations, the tower pantry may include a reinforcing member configured to reduce distortion of the frames. In these implementations, the reinforcing member may have a curved surface that is periodically bent, and ribs may connect at least one of bottoms and tops of the curved surface. In addition, in these implementations, the reinforcing member may include a lower reinforcing member fixed between the frames, and an upper reinforcing member that is rotatable by 90 degrees.

In some examples, both end portions of the upper reinforcing member may have a shape of a semi-cylinder having an opened portion that is configured to fasten to or separate from the frames. In these examples, a projection that defines a rotary center may be located on an inner circumference of the semi-cylinder, a stopper may be located on an outer circumference of the semi-cylinder, and a groove may be located beneath the stopper. The frame cover may have a finishing structure in which each corner is hermetically sealed so that the frames do not protrude upward from the frame cover.

In some implementations, the guide mechanism may be a first guide mechanism, the basket may be a first basket, and the tower pantry may include a second guide mechanism mounted on the frame cover and a second basket attached to the second guide mechanism and configured to move forward and backward on the second guide mechanism. In these implementations, the second guide mechanism may include a rail fixed on the frame cover, and a slide fastened to the second basket and configured to slide along the rail. Holes may be respectively formed at both end portions of the slide, and the second basket may attach to the slide based on shafts that pass through corners of the second basket and that are fastened into the holes. Each corner of the second basket may have a finishing structure hermetically sealed so that the shafts do not protrude upward from the second basket.

In another aspect, a refrigerator includes a wall body that laterally divides an opened space inside a refrigerating room into first and second spaces, one or more shelves dividing the first space divided by the wall body into two or more spaces, and a pantry located in the second space divided by the wall body. The pantry includes a guide mechanism mounted on a bottom of the opened space inside the refrigerating room and a basket attached to the guide mechanism and configured to move forward and backward on the guide mechanism. The pantry also includes frames that are fastened to corners of the first basket and that extend vertically from the basket. The frames have a length that is greater than a height of a gallon size beverage container. The pantry further includes a frame cover fastened on the frames and defining a space that accommodates the gallon size beverage container in the basket.

Implementations may include one or more of the following features. For example, a plurality of shelf hangers configured to support a side of the one or more shelves may protrude from or may be recessed in a surface of the wall body. The one or more shelves may be assembled so that a width of the shelves is adjustable.

In some implementations, the guide mechanism may include a combination of a rail and a slide In these implementations, holes may be respectively formed at both end portions of the slide, and the basket may attach to the slide based on shafts that pass through corners of the basket and that are fastened into the holes. Further, in these implementations, the shafts passing through the corners of the basket may be vertically fastened to the frames.

In some examples, the pantry may include a reinforcing member that has a curved surface that is periodically bent and ribs connecting at least one of bottoms and tops of the curved surface. In these examples, the reinforcing member may include a lower reinforcing member fixed between the frames, and an upper reinforcing member that is rotatable by 90 degrees. In addition, in these examples, the frame cover may have a finishing structure in which each corner is hermetically sealed so that the frame does not protrude upward from the frame cover.

In some implementations, the guide mechanism may be a first guide mechanism and the basket may be a first basket. In these implementations, the pantry may include a second guide mechanism mounted on the frame cover, and a second basket attached to the second guide mechanism and configured to move forward and backward on the second guide mechanism.

DETAILED DESCRIPTION

A tower pantry may allow a large-capacity beverage container, etc. to be kept upright in an internal space of a refrigerating room or to be extracted to the outside of the refrigerating room in a sliding manner. The tower pantry can be applied to a multi-door refrigerator, but also other types of refrigerators that have a sufficiently wide refrigerating room.

Figure 1:
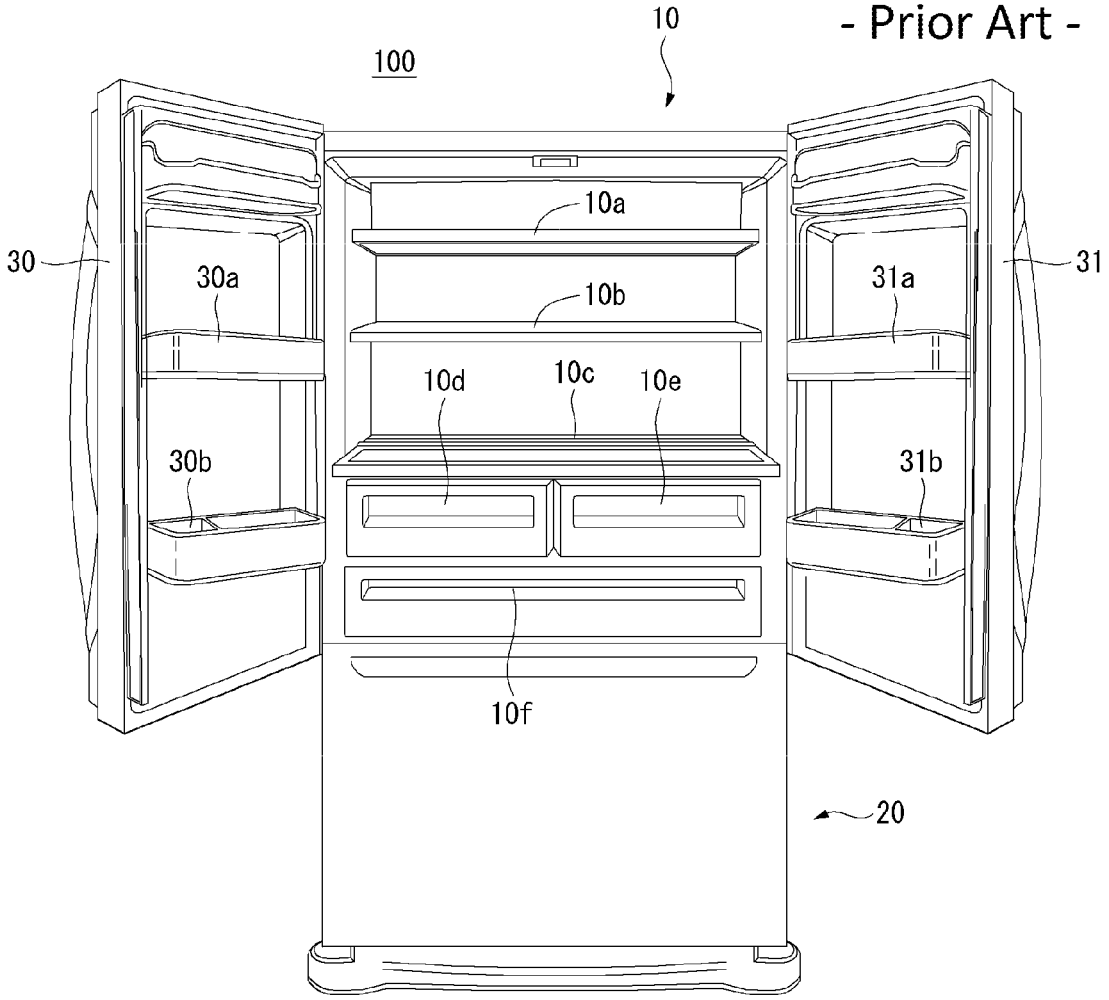
FIG. 1 illustrates an inside of an example prior art refrigerator.
Figure 2:
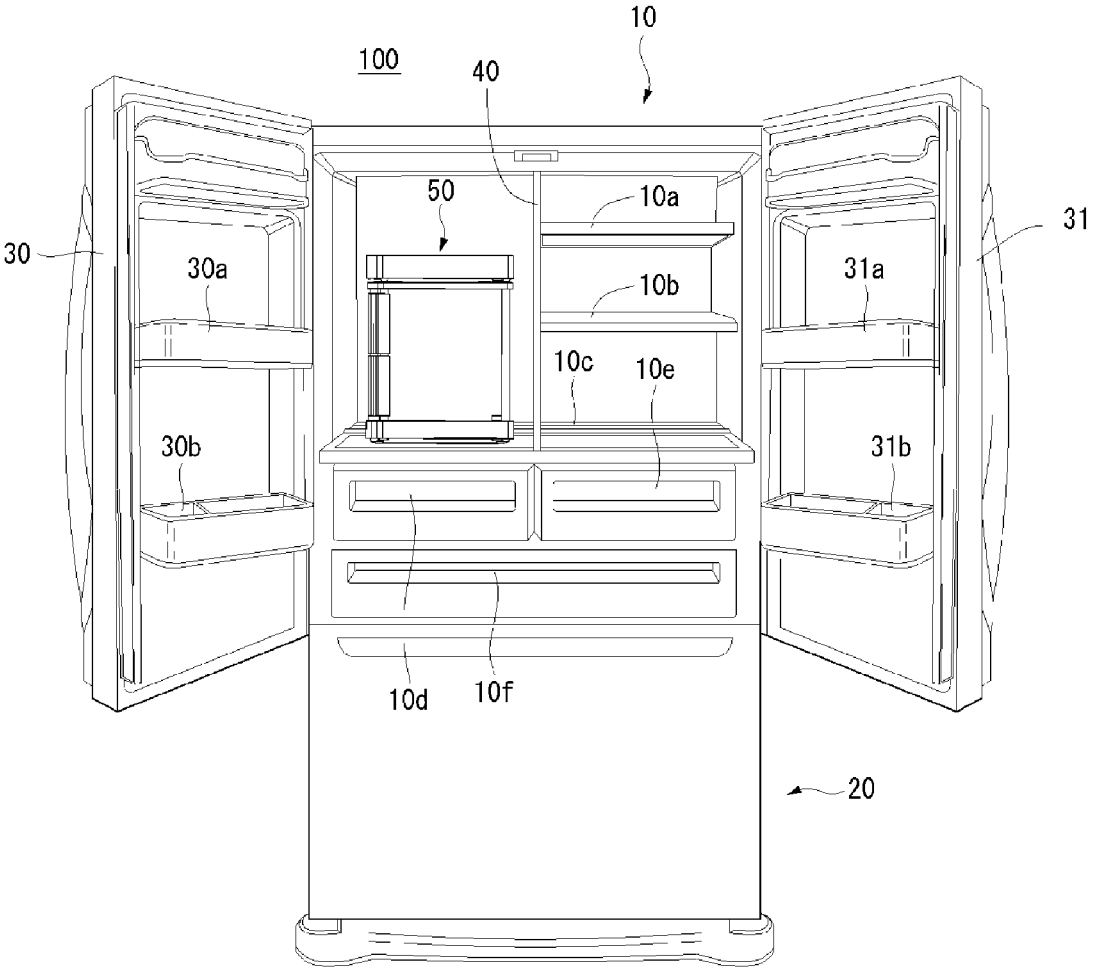
FIG. 2 illustrates an example refrigerator with an example slide-type tower pantry installed in a refrigerating room.

FIG. 2 illustrates an example refrigerator with an example slide-type tower pantry installed in a refrigerating room. The tower pantry is applied to a multi-door refrigerator 100 in which a refrigerating room 10 is disposed on a freezing room 20.

Left and right doors 30 and 31 respectively opened or closed by left and right rotations thereof are mounted at the refrigerating room 10 disposed at the upper portion of the refrigerator 100. One door opened or closed by being pulled forward or pushed backward is mounted at the freezing room 20.

A plurality of drawer-type trays 10*d*, 10*e* and 10*f* providing a sealed space are provided inside the refrigerating room 10. Opened space not occupied by the trays may be partitioned by a plurality of shelves 10*a* and 10*b*, so that objects can be kept layer upon layer. Since vegetables, fruits or fish may be maintained in a state in which their humidity is high or maintained in a state in which their smell is not spread into other spaces, the vegetables, fruits or fish may be kept in a sealed drawer-type tray.

Because an object is put in or taken out through an opening formed at the top of a drawer-type tray in a state in which the drawer-type tray is opened forward, the drawer-type trays may be positioned at a lower portion of the refrigerating room 10. The trays located at the lower portion of the refrigerating room 10 and the opened space at the upper portion of the refrigerating room 10 can be divided by a tray cover 10*c* for covering the uppermost tray.

The opened space above the trays in the refrigerating room 10 can be divided by a wall body 40, into a space in which a tower pantry 50 is installed and a space in which the plurality of shelves 10*a* and 10*b* are mounted. That is, the opened space can be divided into two spaces in the lateral direction of the refrigerating room 10. In FIG. 2, the space for the tower pantry 50 is formed at the left side of the opened space, and the space for the shelves is formed at the right side of the opened space.

A plurality of shelf hangers for supporting sides of the plurality of shelves 10*a* and 10*b* may be protruded or recessed from a surface of the wall body 40. The other sides of the plurality of shelves 10*a* and 10*b* may be supported by a plurality of shelf hangers protruded or recessed from an inner sidewall of the refrigerating room 10.

In FIG. 2, the wall body 40 is fixed at the center of the refrigerating room 10, but other locations are possible. That is, the position of the wall body 40 can be changed based on the width of the tower pantry 50. In addition, the plurality of shelves can be variously assembled so that the width of the shelves can be adjusted according to whether the wall body 40 is mounted in the refrigerating room 10. The wall body 40 can be fixed to two or more of an inner rear surface of the refrigerating room 10, an inner upper surface of the refrigerating room 10 and an upper surface of the tray cover 10*c*.

The tower pantry slides forward/backward along a rail mounted on the tray cover 10*c*. In this example, any mechanism for sliding the tower pantry 50 may be used. The mechanism for sliding the tower pantry may not be mounted on the inner sidewall or rear wall of the refrigerating room 10.

That is, the tower pantry 50 slides along the rail mounted on the tray cover 10*c*. Thus, accommodating the tower pantry 50 may result in relatively little change in the internal structure of the refrigerating room 10.

Shelf-type baskets 30*a*, 30*b*, 31*a* and 31*b* each having an opening can be provided inside the left and right doors 30 and 31 in order to keep beverages and the like therein.

Accordingly, a user may keep food, such as a side dish, on the shelf 10*a* or 10*b* or the tray cover 10*c*, and may keep food, such as vegetables or fish, in the drawer-type tray 10*d*, 10*e* or 10*f*, and may keep a general size beverage, etc. in the shelf-type basket 30, 30*b*, 31*a* or 31*b* provided inside the left or right door 30 or 31.

A large-capacity container containing beverage, etc. with a gallon size can be kept upright in the tower pantry 50 and extracted to the outside of the tower pantry 50 in a sliding manner.

In the refrigerator of FIG. 2, the drawer-type trays are positioned in a lower space inside the refrigerating room 10, and the tower pantry 50 is installed in the space in which the shelves are mounted above the lower space. However, the present disclosure is not limited thereto. In a case where the trays are not positioned in the lower space inside the refrigerating room 10 (e.g., in a case where drawer-type trays are not covered by the door of the refrigerating room, but exposed to the outside of the refrigerator, and a space of the refrigerating room, opened/closed by the door of the refrigerating room, is located on the drawer-type trays), the tower pantry 50 can be mounted on the bottom of an opened space inside the refrigerating room 10.

Figure 3:
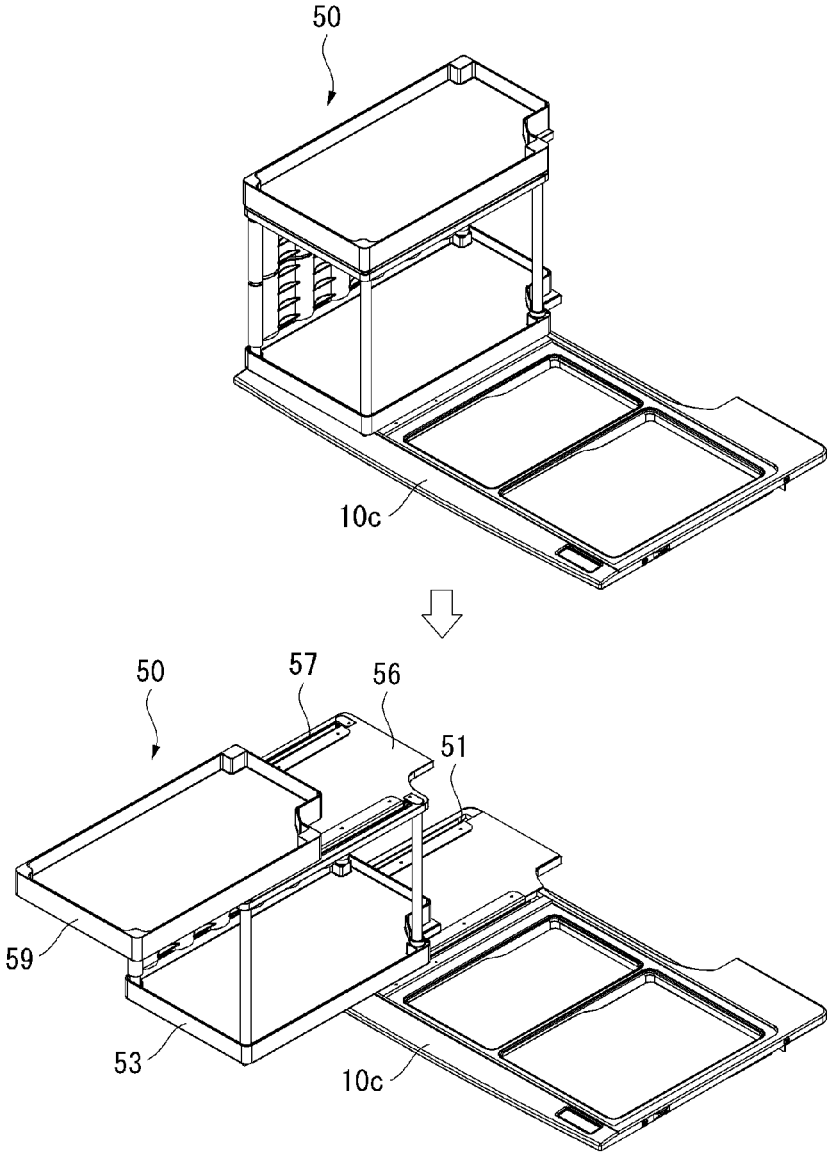
FIG. 3 illustrates sliding movement of the example slide-type tower pantry.

FIG. 3 illustrates sliding movement of the example slide-type tower pantry. For example, the tower pantry 50 that enables a beverage container with a gallon size, etc. to be kept upright therein may be configured to slide forward/backward along a rail mounted inside the refrigerating room on the tray cover 10*c*.

The tower pantry 50, as shown in FIG. 3, can have a double-layered structure in which a first basket 53 and a second basket 59 are vertically arranged. The first basket 53 can be slid by a first guide mechanism 51 mounted on the tray cover 10*c*, and the second basket 59 can be slid by a second guide mechanism 57 mounted on a frame cover 56.

A large-capacity beverage container with a gallon size can be kept upright in the first basket 53, and a general size beverage container or food container can be kept in the second basket 59.

Figure 4:
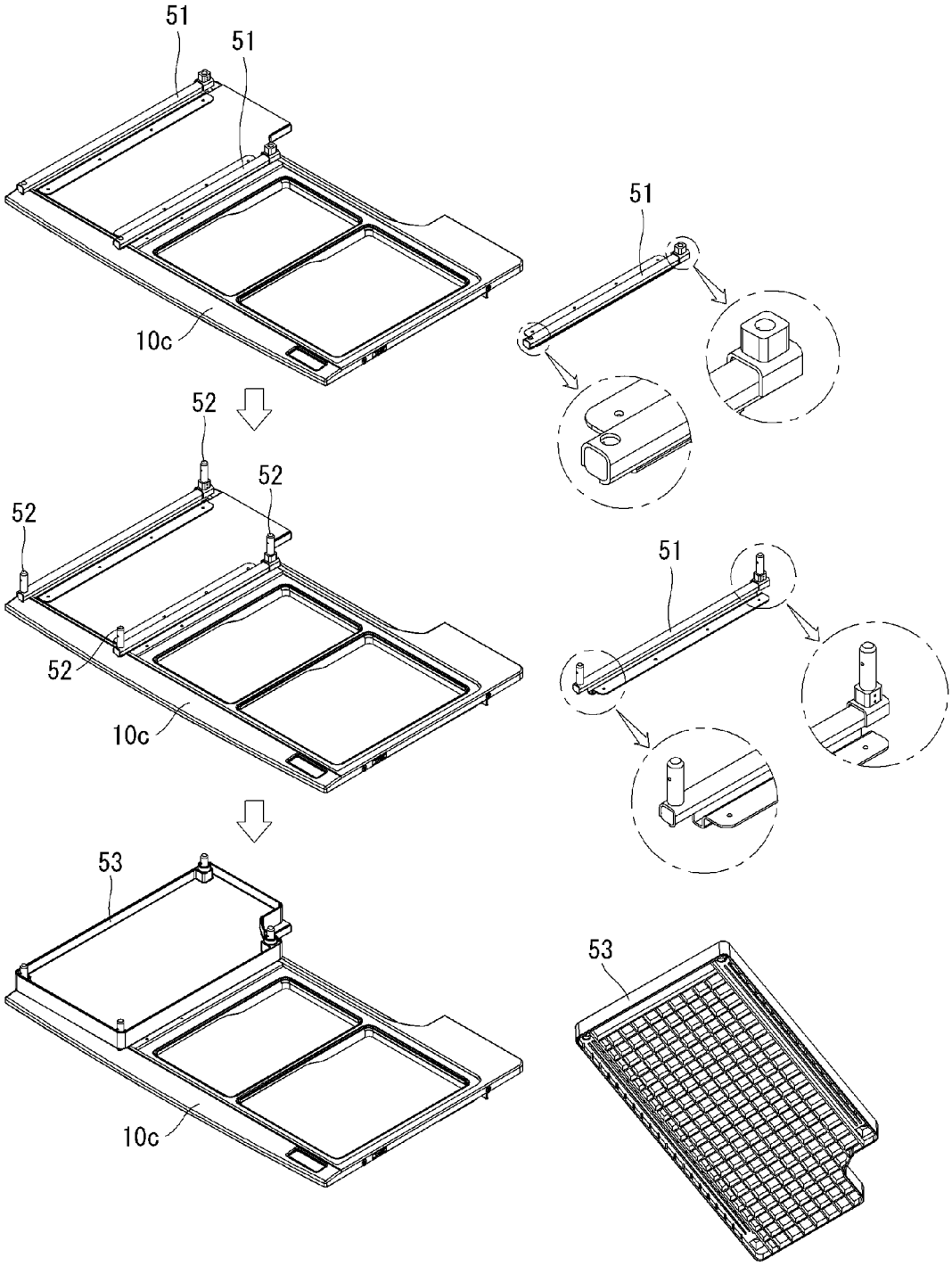
FIGS. 4 to 6 illustrate an example configuration and an example assembling process of the example slide-type tower pantry.
Figure 5:
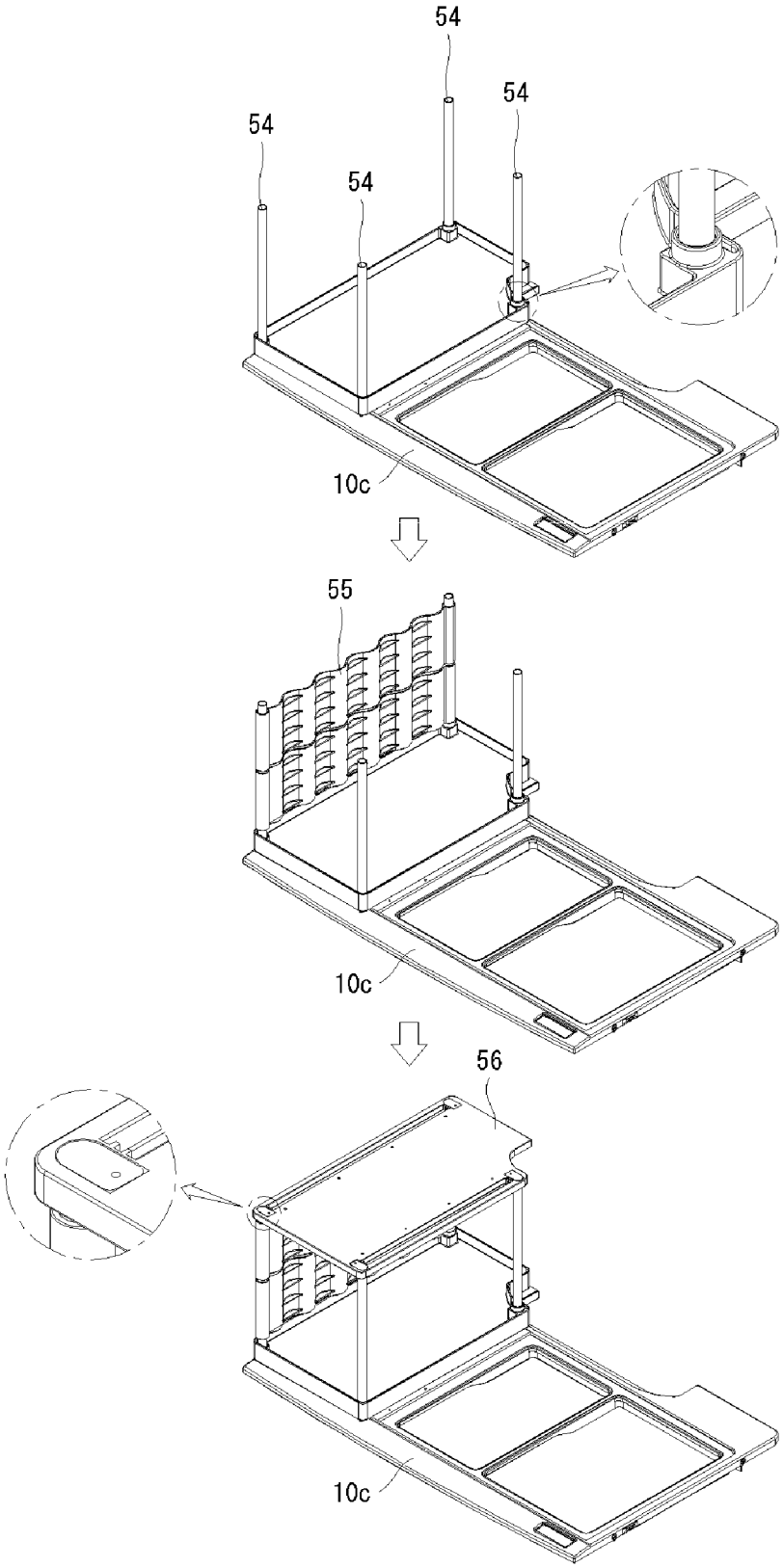
Figure 6:
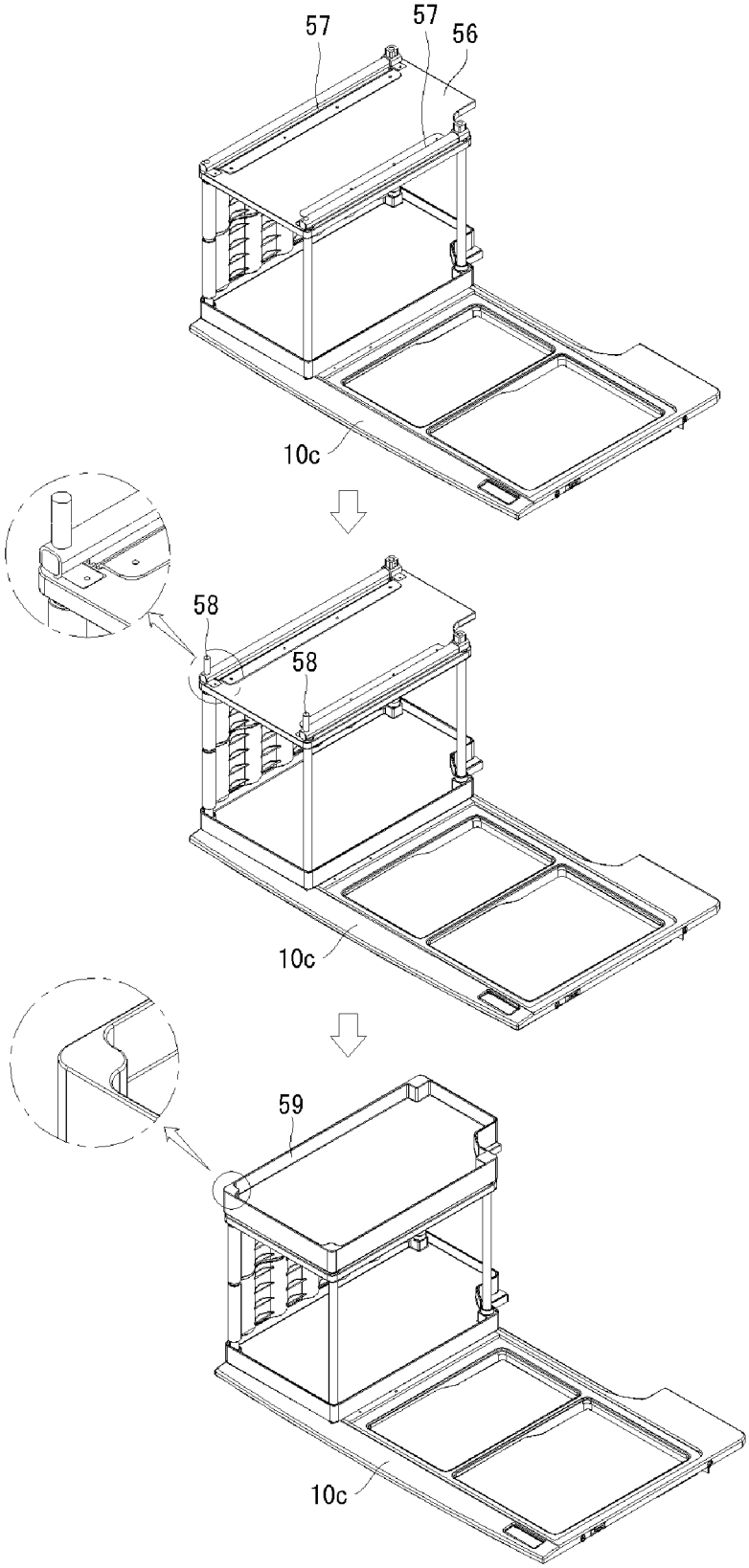

FIGS. 4 to 6 illustrate an example configuration and an example assembling process of the slide-type tower pantry 50. As shown in FIG. 4, the first guide mechanism 51 is mounted at one side on the tray cover 10*c*.

The first guide mechanism 51 can have a structure in which a pair of rails are firmly fixed in parallel to each other at a predetermined interval on the tray cover 10*c*. Sides that slide forward/backward along the respective pair of rails may be assembled as one assembly. Holes for allowing shafts 52 with a predetermined length to be inserted therein are formed at both end portions of the slides, respectively.

The shafts 52 with the predetermined length are fixed by respectively being inserted into the holes formed at both the end portions of the slides. In this case, the shaft 52 can be firmly fastened to the slide through screw-coupling.

The shafts 52, as shown in FIG. 4, are protruded upward while respectively passing through holes formed at rectangular corner portions of the first basket 53. The shafts 52, as shown in FIG. 5, are firmly fastened vertically to four frames 54 having a pipe shape made of stainless steel (STS), respectively.

A right rear surface of the first basket 53 may be formed in a rounded manner to accommodate a rounded prominence formed on an inner rear surface of the refrigerating room.

The four frames 54 have, for example, a height at which a large-capacity beverage container with a gallon size can be kept upright, and the frame cover 56 is fastened to the four frames 54 on the four frames 54. To reduce shaking of the frame cover 56, as shown in FIG. 5, a side member 55 can be fastened as a reinforcing member between two frames among the four frames.

For example, the side member 55 is additionally provided with a curved surface such as a sine curve, which is periodically bent, and ribs connecting bottoms and/or tops of the curved surface. Hence, the curved surface and the ribs can reinforce the strength of the side member 55, thereby more efficiently reducing (e.g., preventing) the bending and distortion of the four frames 54 supporting the frame cover 56.

In a case where the side member 55 is mounted at the rear side of the tower pantry, the side member 55 may block the inflow of cool air. In a case where the side member 55 is mounted at the right side of the tower pantry, the user may experience inconvenience when inserting or extracting a beverage container into or from the first basket 53. Accordingly, in this example, the side member 55 is fastened at only the left side, i.e., the side closest to the inner sidewall of the refrigerating room.

In addition, grooves for fixing the frames 54 are respectively formed at corners in the bottom surface of the frame cover 56, and the top of the frame cover 56 has a finishing structure in which each corner is hermetically sealed so that the pipe-shaped frame 54 is not protruded upward from the frame cover 56. As shown in FIG. 6, the second guide mechanism 57 is mounted on the frame cover 56.

The second guide mechanism 57 can have a structure in which a pair of rails are firmly fixed in parallel to each other at a predetermined interval on the frame cover 56. Slides that slide forward/backward along the respective pair of rails may be assembled as one assembly. Holes for allowing shafts 58 with a predetermined length to be inserted therein are formed at front sides or both end portions of the slides, respectively.

The shafts 58 with the predetermined length are fixed by respectively being inserted into the holes formed at the front sides or both end portions of the slides. In this case, the shafts 58 can be firmly fastened to the slide through screw-coupling.

The shafts 58, as shown in FIG. 6, are inserted into holes formed at rectangular corners of the second basket 59, respectively. In this case, the rectangular corners of the second basket 59 have a sealed finishing structure in which the holes are not viewed so that the shafts are not protruded upward.

Accordingly, a large-capacity beverage container with a gallon size can be kept upright in the first basket 53, and a general size beverage container or food container can be kept in the second basket 59.

The user can easily extract a beverage container with a gallon size from the first basket 53 after pulling forward the first basket 53. Alternatively, the user can extract beverage or food put in the second basket 59 in the state in which the first basket 53 is slid forward.

In addition, the user can extract beverage or food put in the second basket 59 after pulling forward only the second basket 59 such that the first basket 53 is maintained in a position backward of the second basket 59. Alternatively, the user can extract beverage or food put in the second basket 59 after pulling forward the second basket 59 in a state in which the first basket 53 also is slid forward.

Figure 7:
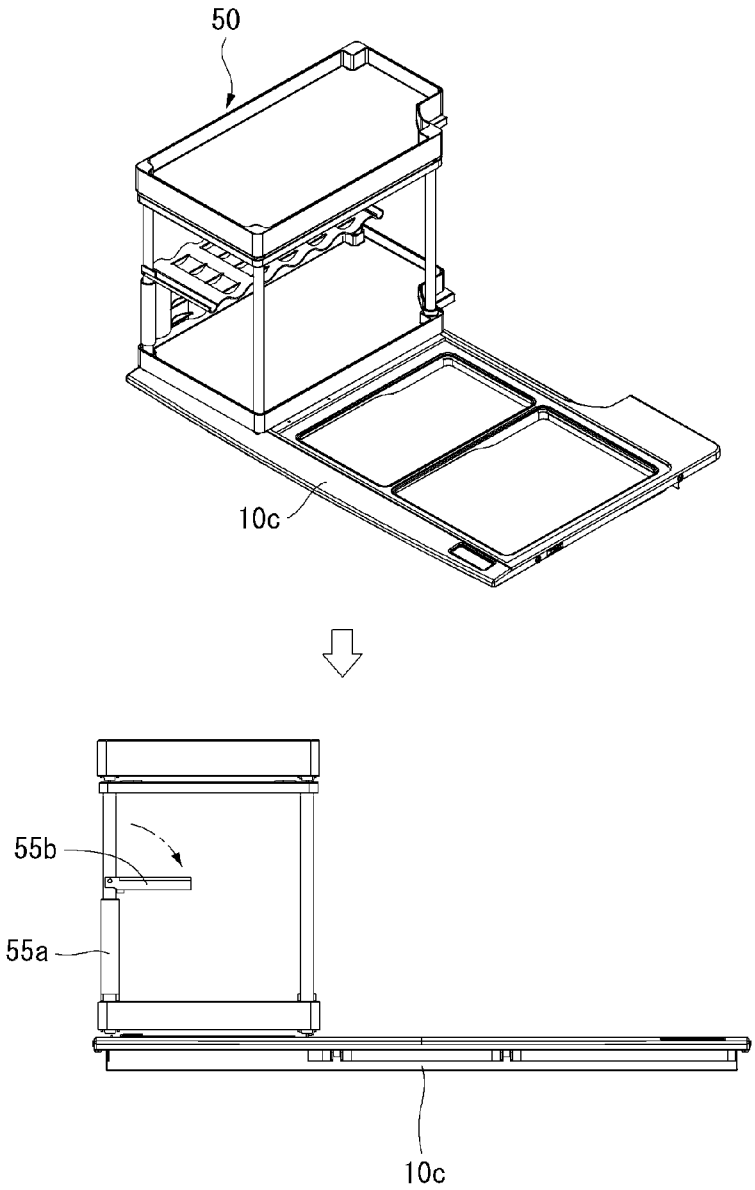
FIGS. 7 to 9 illustrate an example tower pantry in which a portion of a reinforcing member is used as a shelf.

Further, as shown in FIG. 7, the side member 55 assembled as a reinforcing member between the pipe-shaped frames can be divided into a lower side member 55*a* and an upper side member 55*b*. Particularly, the user can rotate inward the upper side member 55*b* by 90 degrees.

Figure 8:
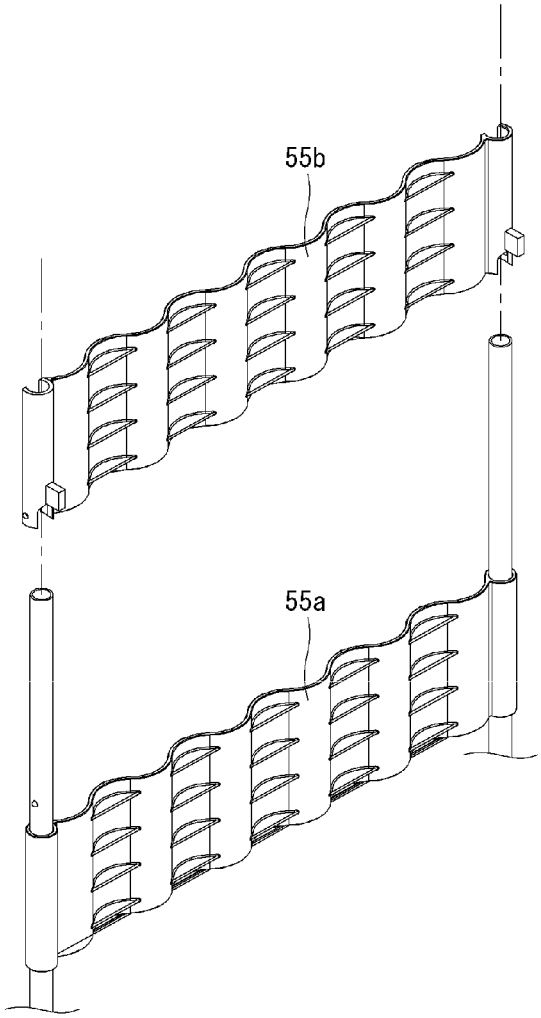

As shown in FIG. 8, long cylinders each having a hole made at the center thereof are respectively formed at both end portions of the lower side member 55*a* so that the two frames 54 closest to the inner sidewall of the refrigerating room are inserted into the respective cylinders, thereby reducing (e.g., preventing) distortion of the frames 54. Both end portions of the upper side member 55*b* have a shape of a long semi-cylinder having an opened portion (e.g., when a cylinder having a hole made at the center thereof is viewed from its top, the angle of a circular arc formed by cutting away a portion of the circle is greater than 180 degrees). The end portions of the upper side member 55*b* can be fastened to or separated from the pipe-shaped frame 54 by the turning force that the user applies.

A projection inserted into a hole formed in the pipe-shaped frame is formed on an inner circumference of the semi-cylinder so as to form a rotary center of the upper side member 55*b*, and a stopper, for example a rectangular protrusion, is formed at an outer circumference of the upper side member 55*b*, so that the upper side member 55*b* is stopped by the frame 54 when rotated by 90 degrees. In the semi-cylinder, a groove can be formed beneath the stopper so that, when the upper side member 55*b* is rotated, the semi-cylinder does not come in contact with the frame 54.

Figure 9:
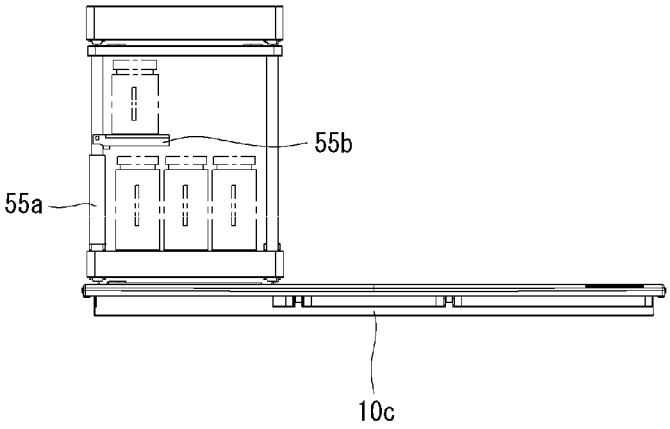

Accordingly, when a large-capacity beverage container with a gallon size is not kept upright in the first basket 53, the user, as shown in FIG. 9, may partition a space between the first and second baskets 53 and 59 into two spaces by rotating the upper side member 55*b* by 90 degrees, so that a larger number of light objects with low heights can be kept in the tower pantry.

As described above, structure and operational examples of a refrigerator have been described with reference to the appended drawings. However, the present disclosure is not limited to the above. Various modifications and implementation of different examples are possible.

The slide-type tower pantry may enable a large-capacity beverage container with a gallon size to be conveniently kept upright and to be easily extracted to the outside of the refrigerating room in a sliding manner.

Further, the slide-type tower pantry may be installed in the refrigerating room without changing (or without significantly changing) the internal structure of refrigerating room.

Further, the slide-type tower pantry may enable the internal space of the refrigerating room to be efficiently used.

What is claimed is:

1. A tower pantry in a refrigerator, comprising:

a guide mechanism including a rail fixed to a bottom of an opened space inside a refrigerating room and a slide configured to slide along the rail, first holes being respectively formed at both end portions of the slide;

a basket that has second holes formed at its corners and that is configured to move forward and backward on the guide mechanism, the basket attaching to the slide based on shafts that are fastened into the first holes and that pass through the second holes;

frames that are fastened to the shafts passing through the second holes at the corners of the basket and that extend vertically from the basket;

a frame cover fastened on the frames; and a reinforcing member configured to reduce distortion of the frames, wherein the reinforcing member includes a lower reinforcing member fixed between the frames, and an upper reinforcing member that is rotatable by 90 degrees.

2. The tower pantry of claim 1, wherein the reinforcing member has a curved surface that is periodically bent, and ribs connect at least one of bottoms and tops of the curved surface.

3. The tower pantry of claim 1, wherein both end portions of the upper reinforcing member have a shape of a semi-cylinder having an opened portion that is configured to fasten to or separate from the frames, wherein a projection that defines a rotary center is located on an inner circumference of the semi-cylinder, and a stopper is located on an outer circumference of the semi-cylinder, and wherein a groove is located beneath the stopper.

4. The tower pantry of claim 1, wherein the frame cover has a finishing structure in which each corner is hermetically sealed so that the frames do not protrude upward from the frame cover.

5. The tower pantry of claim 1, wherein the guide mechanism is a first guide mechanism and the basket is a first basket, further comprising:

a second guide mechanism mounted on the frame cover; and a second basket attached to the second guide mechanism and configured to move forward and backward on the second guide mechanism.

6. The tower pantry of claim 5, wherein the second guide mechanism includes a rail fixed on the frame cover, and a slide fastened to the second basket and configured to slide along the rail, and wherein holes are respectively formed at both end portions of the slide, and the second basket attaches to the slide based on shafts that pass through corners of the second basket and that are fastened into the holes.

7. The tower pantry of claim 6, wherein each corner of the second basket has a finishing structure hermetically sealed so that the shafts do not protrude upward from the second basket.

8. The tower pantry of claim 1:

wherein the frames have a length that is greater than a height of a gallon size beverage container, and wherein the frame cover defines a space that accommodates the gallon size beverage container in the basket.

9. A refrigerator comprising:

a wall body that laterally divides an opened space inside a refrigerating room into first and second spaces;

one or more shelves dividing the first space divided by the wall body into two or more spaces; and a pantry located in the second space divided by the wall body, wherein the pantry includes:

a guide mechanism including a rail fixed to a bottom of the opened space inside the refrigerating room and a slide configured to slide along the rail, first holes being respectively formed at both end portions of the slide, a basket that has second holes formed at its corners and that is configured to move forward and backward on the guide mechanism, the basket attaching to the slide based on shafts that are fastened into the first holes and that pass through the second holes, frames that are fastened to the shafts passing through the second holes at the corners of the basket and that extend vertically from the basket, a frame cover fastened on the frames, and a reinforcing member configured to reduce distortion of the frames, wherein the reinforcing member includes a lower reinforcing member fixed between the frames, and an upper reinforcing member that is rotatable by 90 degrees.

10. The refrigerator of claim 9, wherein a plurality of shelf hangers configured to support a side of the one or more shelves protrude from or are recessed in a surface of the wall body.

11. The refrigerator of claim 9, wherein the one or more shelves are assembled so that a width of the shelves is adjustable.

12. The refrigerator of claim 9, wherein the reinforcing member has a curved surface that is periodically bent, and ribs connecting at least one of bottoms and tops of the curved surface.

13. The refrigerator of claim 9, wherein the frame cover has a finishing structure in which each corner is hermetically sealed so that the frame does not protrude upward from the frame cover.

14. The refrigerator of claim 9, wherein the guide mechanism is a first guide mechanism and the basket is a first basket and wherein the pantry further includes a second guide mechanism mounted on the frame cover, and a second basket attached to the second guide mechanism and configured to move forward and backward on the second guide mechanism.

15. The refrigerator of claim 9:

wherein the frames have a length that is greater than a height of a gallon size beverage container, and wherein the frame cover defines a space that accommodates the gallon size beverage container in the basket.

16. A tower pantry in a refrigerator, comprising:

a guide mechanism mounted on a bottom of an opened space inside a refrigerating room;

a basket attached to the guide mechanism and configured to move forward and backward on the guide mechanism;

frames that are fastened to corners of the basket and that extend vertically from the basket; and a frame cover fastened on the frames; and a reinforcing member configured to reduce distortion of the frames, wherein the reinforcing member includes a lower reinforcing member fixed between the frames, and an upper reinforcing member that is rotatable by 90 degrees, wherein both end portions of the upper reinforcing member have a shape of a semi-cylinder having an opened portion that is configured to fasten to or separate from the frames, wherein a projection that defines a rotary center is located on an inner circumference of the semi-cylinder, and a stopper is located on an outer circumference of the semi-cylinder, and wherein a groove is located beneath the stopper.

* * * * *